US008425685B2

(12) United States Patent
Kim et al.

(10) Patent No.: US 8,425,685 B2
(45) Date of Patent: Apr. 23, 2013

(54) METHOD FOR CONTROLLING A DISH WASHING MACHINE

(75) Inventors: Seong Ho Kim, Seoul (KR); Tae Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 962 days.

(21) Appl. No.: 11/896,496

(22) Filed: Aug. 31, 2007

(65) Prior Publication Data

US 2008/0236624 A1 Oct. 2, 2008

(30) Foreign Application Priority Data

Mar. 31, 2007 (KR) ..... 10-2007-0032117

(51) Int. Cl.
*B08B 7/04* (2006.01)

(52) U.S. Cl.
USPC ..... 134/18; 134/31; 134/25.2

(58) Field of Classification Search ..... 134/18, 134/31, 25.2, 42, 56 D, 57 D, 58 D
See application file for complete search history.

(56) References Cited

U.S. PATENT DOCUMENTS

| | | | | |
|---|---|---|---|---|
| 4,298,789 | A * | 11/1981 | Eichelberger et al. | 219/406 |
| 4,457,323 | A | 7/1984 | Fay et al. | |
| 2004/0040586 | A1 * | 3/2004 | Kumar | 134/26 |
| 2004/0187898 | A1 * | 9/2004 | Chen | 134/58 D |
| 2004/0228052 | A1 * | 11/2004 | Hering et al. | 361/78 |

FOREIGN PATENT DOCUMENTS

| | | | |
|---|---|---|---|
| GB | 602848 | | 6/1948 |
| GB | 775975 | | 5/1957 |
| JP | 2006314667 | A * | 11/2006 |
| WO | WO 2006101365 | A1 * | 9/2006 |

OTHER PUBLICATIONS

Machine Translation: JP 2006-314667 to Yoshikawa, et al. Nov. 2006.*

* cited by examiner

*Primary Examiner* — Eric Golightly
(74) *Attorney, Agent, or Firm* — McKenna Long & Aldridge LLP

(57) ABSTRACT

A dish washing machine and a control method of the same are disclosed. The control method of a dish washing machine includes supplying water into a washing compartment through spray arms, a first supplying steam, generated by a first steam generator, into the washing compartment, and when the abnormal operation of the steam generator is detected, terminating the operation of the first stem generator.

9 Claims, 5 Drawing Sheets

METHOD FOR CONTROLLING A DISH WASHING MACHINE

CROSS-REFERENCE TO RELATED APPLICATION

This application claims the benefit of Korean Patent Application No. 2007-32117, filed on Mar. 31, 2007, which is hereby incorporated by reference in its entirety as if fully set forth herein.

BACKGROUND

1. Field of the Disclosure

The disclosure relates to a control method of a home appliance, and more particularly, to a control method of a dish washing machine that is capable of more efficiently washing dishes.

2. Discussion of the Related Art

Generally, dish washing machines are known as an apparatus for automatically washing dishes disposed in a washing compartment by spraying wash water toward the dishes under high pressure, thus removing foreign matter such as food residue attached to the surfaces of the dishes.

One important factor associated with such a dish washing machine is the ability to completely remove food residue attached to the surfaces of dishes such that the dishes are properly cleaned. In order to achieve an enhancement in this ability, it is necessary to increase the force required to remove foreign matter from the surfaces of dishes, namely, the spray pressure of wash water. The related art has the disadvantage that when the spray pressure of the wash water is excessively high, the dishes may be damaged or easily broken. A further disadvantage is that when the washing of dishes is carried out at an increased spray pressure, the amount of wash water required in this washing operation is increased. Also, when wash water of an increased spray pressure is used, it is necessary to increase the power consumption of a pump used to supply the wash water.

Accordingly what is needed is a dish washing machine that operates more efficiently resulting in less water and power consumption, as well as will not damage the dishes.

SUMMARY

The disclosure is directed to a dish washing machine and a control method of the same that substantially obviates one or more problems due to limitations and disadvantages of the related art.

The exemplary embodiments disclosed herein use steam in the dish washing machine in order to improve the washing efficiency of the dish washing machine without damage to dishes. The steam soaks into and softens foreign matter attached to the dishes such that the foreign matter may be more easily removed. Therefore, the steam improves the washing efficiency of the dish washing machine so that a somewhat low pressure wash water spray will still clean the dishes.

In order to supply steam, the dish washing machine according to the disclosure includes a steam generator having a heater mounted therein. As the dish washing machine is used for a long period of time, the performance of the respective parts of the dish washing machine may deteriorate with the result that the respective parts of the dish washing machine may no longer function. The steam generator may also experience similar deterioration from long-term use.

A control method for a dish washing machine that is capable of effectively dealing with the abnormal operation of the steam generator in the dish washing machine is highly desirable.

Advantages and features will be set forth in part in the description which follows and in part will become apparent to those having ordinary skill in the art upon examination of the following or may be learned from practice of the invention. The aforementioned advantages and features of the invention may be realized and attained by the exemplary structure and or method pointed out in the written description, claims, and the appended drawings.

The advantages maybe achieved by a control method for a dish washing machine includes supplying water into a washing compartment through spray arms, a first supplying steam, generated by a first steam generator, into the washing compartment, and when an abnormal operation of the steam generator is detected, terminating the operation of the first stem generator.

The advantages may further be achieved by a method for controlling a dish washing machine may comprises supplying water into a washing compartment through spray arms, operating a first steam generator to supply steam into the washing compartment, terminating the operation of the first steam generator when the abnormality of the first steam generator is detected, and operating an second steam generator mounted separately from the first steam generator.

It is to be understood that both the foregoing general description and the following detailed description are exemplary and explanatory and shall not be construed as limiting the scope of the claims.

BRIEF DESCRIPTION OF THE DRAWINGS

The accompanying drawings, which are included to provide a further understanding of the invention and are incorporated in and constitute a part of this application, illustrate exemplary embodiments of the disclosure and together with the description serve to explain the principle of the invention. In the drawings.

DETAILED DESCRIPTION

Figure 1:
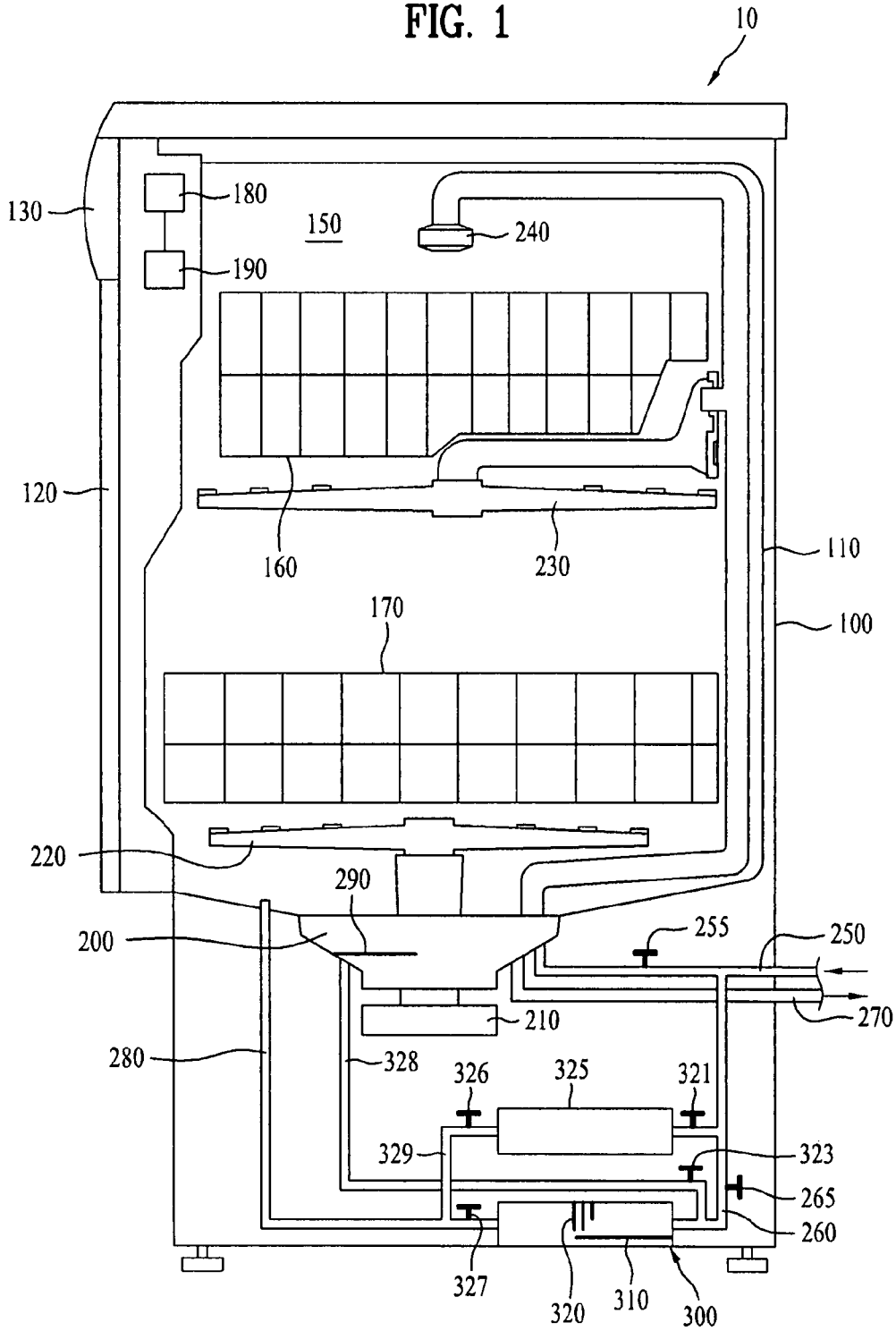
FIG. 1 is a view schematically illustrating a dish washing machine according to the present invention.

Reference will now be made in detail to the exemplary embodiments of the disclosure, examples of which are illustrated in the accompanying drawings. Wherever possible, the same reference numbers will be used throughout the drawings to refer to the same or like parts.

The configuration of a dish washing machine 10 according to an exemplary embodiment of the present invention will be described with reference to FIG. 1.

The illustrated dish washing machine may include a case 100 defining the exterior appearance of the dish washing machine, a door 120 for opening or closing case 100, and a control panel 130 mounted to case 100 or door 120, to enable the user to manipulate the dish washing machine.

A tub 110 is arranged in case 100, defining a washing compartment 150 in case 100. Washing compartment 150 creates a space in which dishes are received and washed. A sump 200 may be disposed beneath tub 110 for storing wash water.

A pump 210 may be disposed in sump 200 for pumping the wash water stored in the sump 200. A filter (not shown) may be also located in sump 200 for filtering contaminated wash water. A first heater 290 may be arranged in sump 200, to heat the wash water stored in sump 200.

A first water supply tube 250 may be connected to sump 200, to supply fresh water from an external water supply source to sump 200. A water discharge tube 270 may also be connected to sump 200, to externally discharge the wash water from the sump 200. A first water supply valve 255 may be arranged in water supply tube 250 for controlling the supply of water to sump 200.

At least one rack (160 or 170) is arranged in the interior of tub 110, namely, washing compartment 150. At least one spray arm is also arranged in washing compartment 150, to spray the water pumped by pump 210 toward the at least one rack.

FIG. 1 illustrates an example in which an upper rack 160 and a lower rack 170 are arranged at upper and lower portions of washing compartment 150, respectively. Further an upper spray arm 230 and a lower spray arm 220 are arranged such that they spray water pumped by pump 210 toward upper rack 160 and lower rack 170, respectively.

In addition, a top nozzle 240 may be arranged at a top portion of the washing compartment 150. Top nozzle 240 functions to spray water that is pumped by pump 210 in a downward direction from the top portion of washing compartment 150.

The dish washing machine according to the illustrated embodiment is configured to spray or supply steam to washing compartment 150 in addition to spraying wash water into washing compartment 150 from pump 210 and through spray arms 220 and 230. The dish washing machine includes a steam generator 300 which operates independently from first heater 290, which is arranged in the sump 200.

As shown in FIG. 1, steam generator 300 communicates with first water supply tube 250 via a second water supply tube 260. Steam generator 300 also communicates with washing compartment 150 of tub 110 via a steam supply tube 280. A second water supply valve 265 for controlling the supply of water to steam generator 300 may be arranged on second water supply tube 260.

Steam generator 300 includes a second heater 310 for heating water supplied to steam generator 300, and a water level sensor 320 for sensing the water level of the steam generator 300. Water level sensor 320 may sense, for example, a minimum water level and a maximum water level.

The minimum water level may be set to protect the second heater 310 of the steam generator 300. The maximum water level may also be set to prevent the water supplied to steam generator 300 from overflowing. Also, steam generator 300 may be provided with a steam supply valve 327 for controlling the opening and closing of the steam supply tube 280, thus supplying steam at predetermined time.

Steam generator 300 may be connected to the sump via an auxiliary water supply tube 328. In order to generate steam in this manner, steam generator 300 heats the wash water that passes through sump 200. An auxiliary valve 323 may also be mounted on the auxiliary water supply tube 328 for controlling the supply of water between sump 200 and steam generator 300.

As illustrated in FIG. 1, the dish washing machine further includes a control unit 180, for controlling the dish washing machine. As known in the art, control unit 180 may be in communication with a memory 190 that may store instructions used by control unit 180 to execute the steps of control methods in accordance with the exemplary embodiments of the invention. Control unit 180 may be electrically coupled to electrically-operating elements, for example; control unit 130, pump 210, and steam generator 300, to control operation of the dish washing machine.

In general, a control method is implemented through a series of steps and cycles that are stored in memory 190 and communicated to the control unit 180. For example, control unit 180 controls at least first heater 290, second heater 310, pump 210, and steam generator 300 according to an operation mode of the dish washing machine. A procedure for controlling the above-specified parts of the dish washing machine according to the operation mode of the dish washing machine will be described below.

Figure 2:
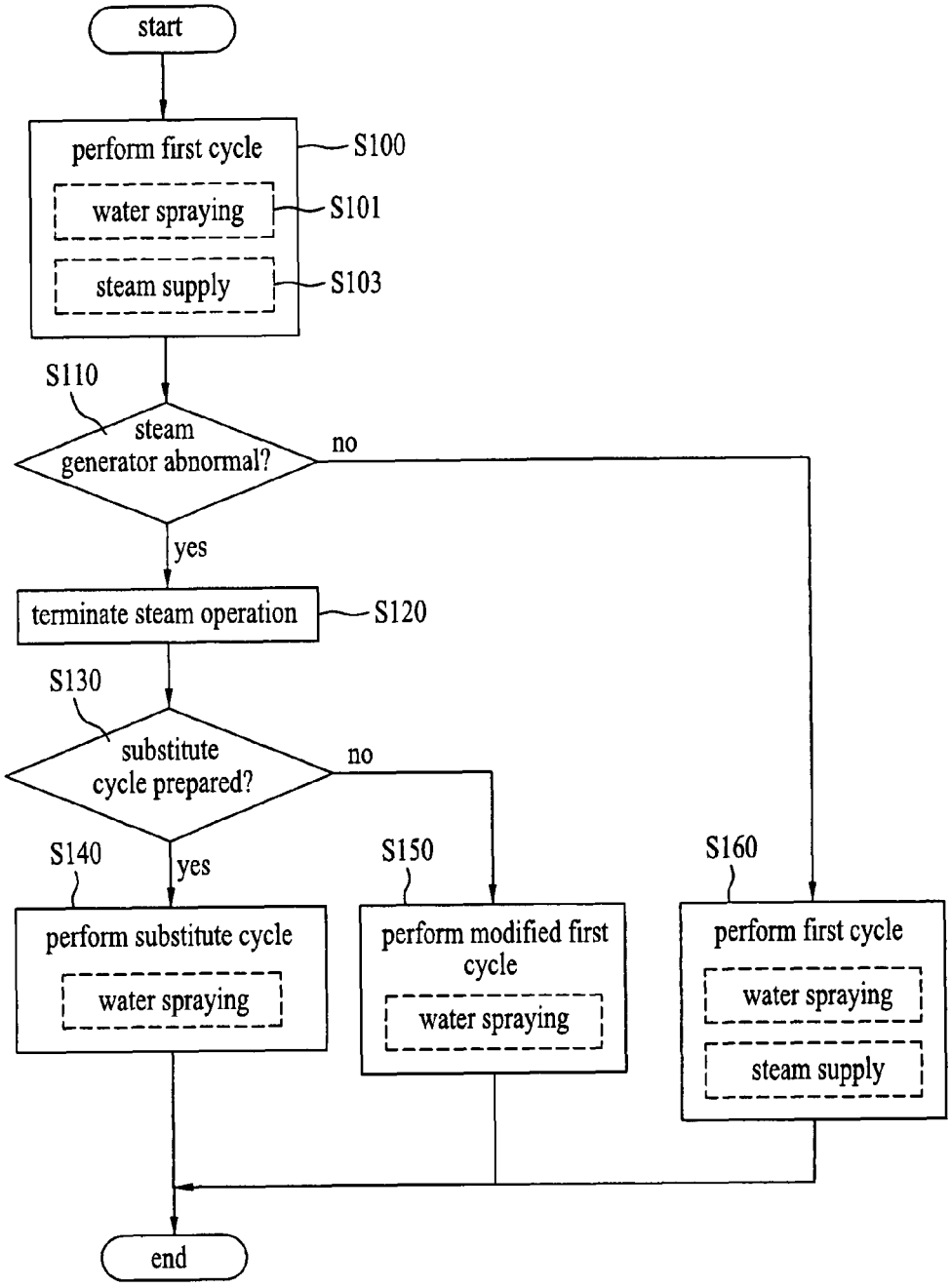
FIG. 2 is a flow chart illustrating a control method of the dish washing machine according to the present invention.
Figure 3:
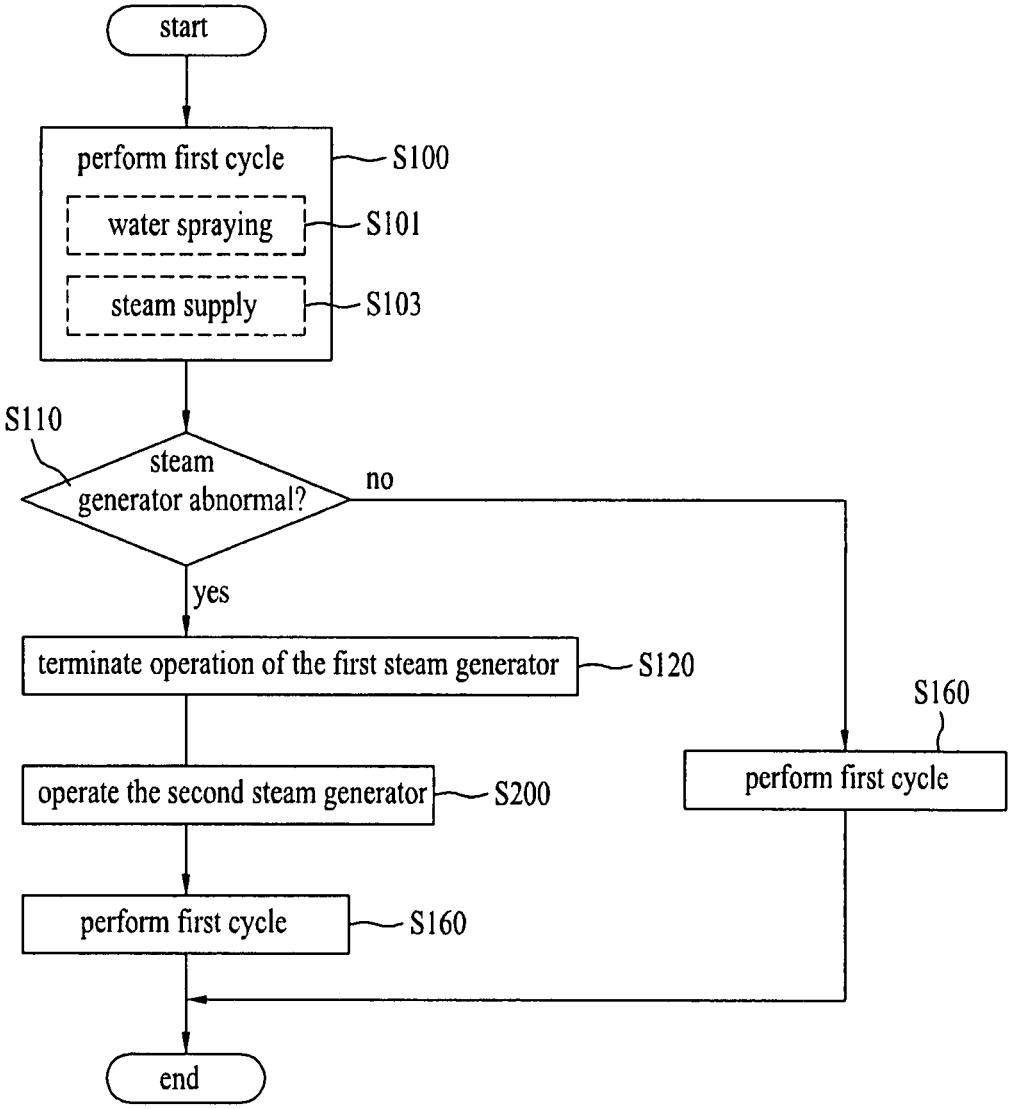
FIG. 3 is another flow chart illustrating a control method of the dish washing machine according to the present invention.
Figure 4:
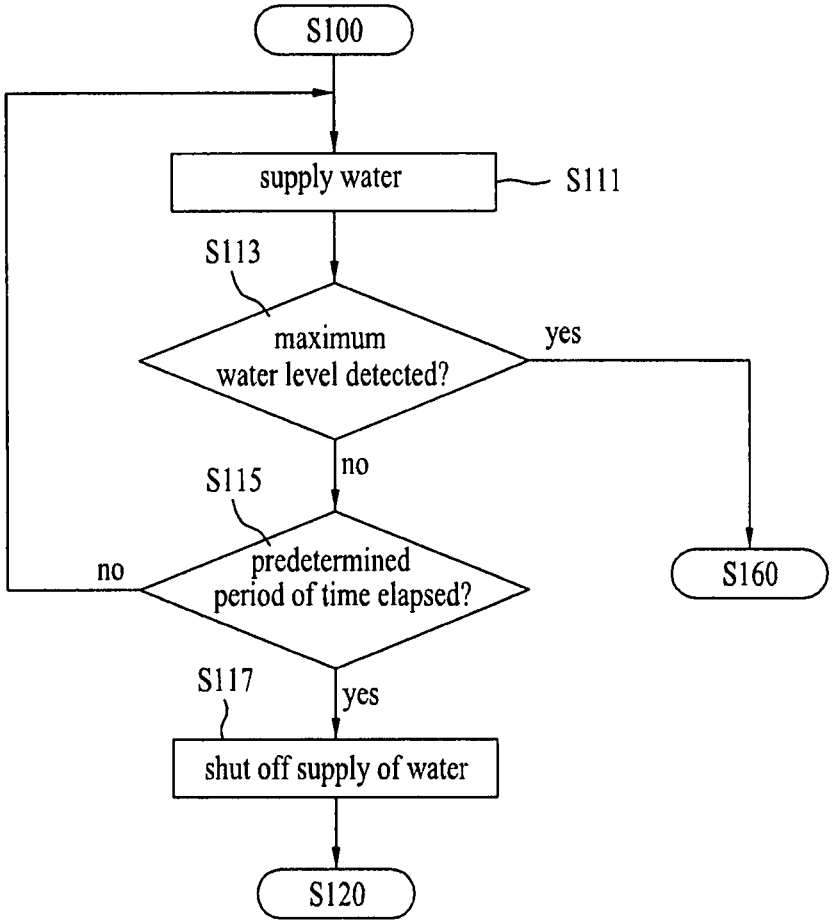
FIGS. 4 and 5 are flow charts illustrating processes for detecting the abnormality of a steam generator in the control method of the dish washing machine according to the present invention.
Figure 5:
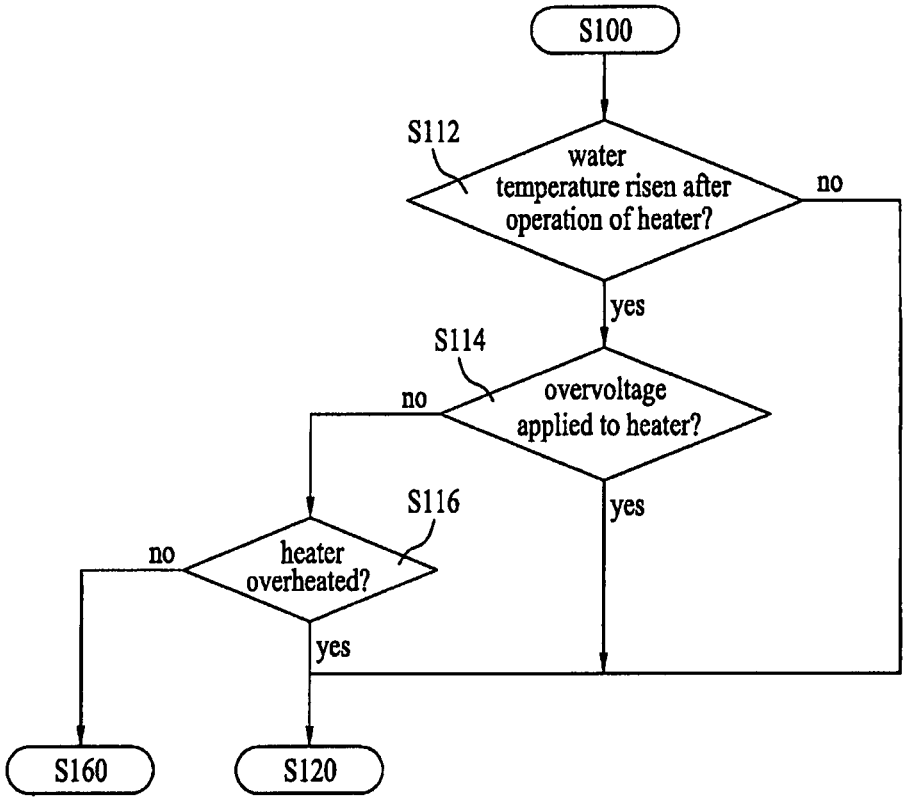

Hereinafter, an exemplary embodiment of the control method of the dish washing machine will be described with reference to FIGS. 2 to 5. FIGS. 2 and 3 are flow charts illustrating control methods of the dish washing machine according to the present invention, and FIGS. 4 and 5 are flow charts illustrating processes for detecting the abnormal operating state of a steam generator in accordance with the control method of the dish washing machine.

When a user wishes to wash dishes using the dish washing machine with the above-stated construction, the user opens the door 120, puts the dishes to be washed in upper and lower racks 160 and 170, and then closes door 120. The user may put a predetermined amount of detergent or rinse into a detergent box (not shown) before closing door 120.

When an operation signal of the dish washing machine is inputted through control panel 130, the dish washing machine performs a predetermined washing process. The washing process may include a preliminary washing course, a main washing course, and a rinsing course, for rinsing dishes after the dishes are washed.

In the preliminary washing process, wash water is sprayed toward the dishes, placed in the washing compartment, for example, for a predetermined period of time. As a result, food residue left on the dishes is partially removed from the dishes by the pressure of the wash water sprayed, and moisture permeates into the foreign matter attached to the dishes such that the foreign matter is softened from the moisture, and therefore, the foreign matter can be easily removed from the dishes.

After the completion of the preliminary washing process, the contaminated wash water is discharged, and then new wash water is supplied for the main washing process. The main washing process may be performed, for example, according to a predetermined first cycle (S100) (see FIG. 2). In the first cycle (S100) the wash water is sprayed toward the dishes through spray arms 160 and 170 such that the dishes are cleanly washed (S101).

Then, in order to improve the washing efficiency, steam may be supplied into washing compartment 150 (S103). Both water and steam may be sprayed into the washing compartment to wash the dishes in the main washing process. At this time, detergent may be mixed or added into the wash water. As the steam is supplied into the washing compartment in the main washing process, the foreign matter attached to the dishes may become saturated by the steam. The steam that is generated has high-temperature, high-humidity characteristics, enhancing the washing efficiency. In order to further improve the washing efficiency, the wash water may be heated by first heater 290, mounted in the sump 200, and sprayed toward the dishes in the main washing process.

In the main washing process, the water and steam may be simultaneously or alternately supplied or sprayed into washing compartment 150. In order to supply the heated wash water and steam simultaneously into the washing compartment 150, it may be required to simultaneously operate first heater 290 mounted in sump 200, and second heater 310 mounted in the steam generator 300.

If both devices 290 and 310 are operated simultaneously, the total power consumption of the washing machine will increase accordingly. Further, the reliability and endurance of the dish washing machine may deteriorate. In order to solve this problem, it is possible to alternately operate first heater 290 mounted in the sump 200 and second heater 310 mounted in steam generator 300 such that the heated wash water and steam can be alternately sprayed toward the dishes (S100 and S160).

As illustrated in FIG. 2, during the execution of the first cycle, while simultaneously or alternately spraying the water and steam for a predetermined period of time (S100), control unit 180 determines whether steam generator 300 is operating abnormally (S110). When abnormal operation of steam generator 300 is detected, control unit 180 may terminate the operation of steam generator 300. Even if steam generator is shut down, other parts of the dish washing machine will continue to run. For example, the operation to spray water into the washing compartment (S101) continues to operate (S140 and S150). The supply of the steam may be an auxiliary means to improve the washing efficiency of the dish washing machine. Therefore, when steam generator 300 is functioning abnormally, the operation of steam generator 300 may be terminated without sacrificing completion of the wash process.

When steam generator 300 is functioning normally, the first cycle, (where water and steam are supplied or sprayed) will continue to run until the main washing process is completed (S160). When it is determined that steam generator 300 is operating abnormally (See FIGS. 4 and 5), however, control unit 180 terminates the steam operation to prevent any damage to steam generator 300 that might occur if it continued to run under adverse or abnormal conditions (S120).

As illustrated in FIG. 2, once the steam generator operation is terminated or turned off, the control unit 180 determines whether another cycle, substituting for the first cycle, is available (S130). This substitute cycle is provided in the event that steam generator 300 is not functioning properly, creating the need to implement an alternate means to properly complete the washing process. If a substitute cycle is prepared control unit 180 will then implement it in order to compensate for the malfunction of steam generator 300 (S140). The substitute cycle is designed such that it employs a method or form of water spraying that is different or varied from the first cycle. It is noted that in the substitute washing cycle, pump 210 may supply water for the water spraying method as it did in the first cycle.

The substitute washing cycle may be performed in a manner that is different from first cycle at S100. The substitute washing cycle may include a step of supplying water, heated not by second heater 310 mounted in the steam generator, but by first heater 290 mounted in the sump, into the washing compartment. In this case the water spraying is carried out according to the program of the substitute cycle. It is also envisioned that first heater 290 may act to produce steam, in order to compensate for the malfunctioning of steam generator 300.

When the substitute cycle is completed, the main washing process is also completed. Consequently, the dish washing machine successfully completes the dish washing process, inputted by the user, even if steam generator 300 is operating abnormally.

If the substitute cycle is not available, the first cycle (S100) will continue to run (S160). In this case, however, the supply or spraying of steam is excluded from the first cycle, and the water spraying by the operation of the pump 210 is continuously carried out.

If the first cycle is completed (at steps S150 or S160), the main washing process is also completed. Accordingly, the dish washing machine successfully completes the dish washing process, inputted by the user, even if steam generator 300 is operating abnormally. After the operation of steam generator 300 is terminated the first or substitute cycle, may enable the wash water to be heated by first heater 290. This heating process is performed so that heated water may be sprayed on the dishes, thereby improving the washing efficiency of the dish washing machine. It is also noted that the step of operating the steam generator S103 may be omitted from the step of performing the first cycle S100, resulting in modified first cycle S150.

The present invention is not limited to the above-described embodiment. Referring to FIG. 3, the dish washing machine according to the present invention may include a first steam generator and a second steam generator such that the second steam generator can be operated when the first steam generator is abnormal. First heater 290 provided at the sump may also be used as a second steam generator for generating steam.

FIG. 3 illustrates another control method of the dish washing machine, which may include the following steps: a step of supplying water into washing compartment 150 through spray arms 220 and 230, a first steam supply step of operating first steam generator 300 to supply steam into washing compartment 150, a step of terminating the operation of first steam generator 300 if the abnormal operation of the first steam generator is detected (S110, S120), and then performing a second steam supply step where a second steam generator 325 is operated (S200). It is noted that second steam generator 325 may be mounted separately in the dish washing machine from first steam generator 300, as illustrated in FIG. 1.

When first steam generator 300 is operating abnormally, the control unit 180 will switch usage to second steam generator 325 by the following process. Control unit 180 first closes a first valve 327 on a first steam supply tube 280. First steam supply tube 280 may serve to feed the interior of washing compartment 150 with steam. When first valve 327 is closed, fluid communication may be prevented between and first steam generator 300 and washing compartment 150. Then control unit 180 opens a second valve 326 disposed on a second steam supply tube 329. Second steam supply tube 329 may act to fluidly couple second steam generator 325 to first steam supply tube 280. Once second valve 326 is opened, second steam generator may be fluidly coupled to the interior of washing compartment 150. This substitution process ensures that steam is continuously supplied into the washing compartment. A water supply valve 321 for controlling the supply of water to steam generator 325 may be arranged on second water supply tube 260.

In order to determine whether steam generator 300 is operating abnormally, control unit 180 monitors several factors. First, the water level in steam generator 300 and the change of water temperature in steam generator 300 are monitored after second heater 310 has been turned on. Further, control unit 180 checks the input voltage applied to heater 310, and the overheating of the heater 310. One of skill will appreciate that this monitoring may be applied to the control methods shown in both FIGS. 2 and 3, and various other washing machine control systems.

Processes for detecting the abnormal operation of the steam generator 300 are illustrated in FIGS. 4 and 5. Hereinafter, these processes will be described in more detail with reference to the figures. In order to supply or spray steam into washing compartment 150, it may be necessary to replenish water at least once, even after water is already supplied once into steam generator 300. Accordingly, as water is being supplied control unit 180 detects the water level in steam generator 300, to determine whether the steam generator 300 is operating under abnormal conditions. As long as steam generation is still necessary control unit 180 will control the supply of water is supplied to steam generator 300 when either water level sensor 320 detects a minimum water level, or when steam is sprayed for a predetermined period of time and then the steam spraying stops (S111).

The water level will rise as the water is supplied into steam generator 300. During the supply of water into steam generator 300, control unit 180 receives a signal from water level sensor 320 when a maximum water level is detected (S113). Then the supply of water into steam generator 300 may be shut off. After the water supply is shut off to steam generator 300, as shown in FIG. 4, the first cycle S100, continues to run until the first cycle is completed (S160).

When water level sensor 320 does not detect the maximum water level, control unit 180 then evaluates whether a predetermined period of time has elapsed after the supply of water into steam generator 300 (S115). If the predetermined period of time has not elapsed, then water is continuously supplied. If the predetermined period of time has elapsed, on the other hand, then the water supply is shut off (S117). The process illustrated in FIG. 4 is necessary because when the maximum water level is not detected after the predetermined period of time, there is a high probability that various things may be wrong. Second water supply valve 265 may be out of order, the supply of water may be stopped, water level sensor 320 may be out of order, or various other instances may be present. Therefore, the water supply is shut off (S117), and the steam operation is terminated (S120). After that the termination of the steam operation Step S130 and subsequent steps may be carried out.

The determination of whether steam generator 300 is operating normally or abnormally through the detection of the water level may be performed differently from the above-described manner. For example, water may be forcibly supplied into steam generator 300 for a predetermined period of time, while the water level in steam generator 300 is monitored. When the maximum water level is detected, the operation of steam generator 300 is resumed. When the maximum water level is not detected, however, the operation of steam generator 300 is terminated. In the above exemplary embodiment, the method of determining that steam generator 300 is operating abnormally depended upon water level sensor 320 detecting the presence of a maximum or minimum water level, however, other methods of determining abnormal operation of steam generator 300 are envisioned.

FIG. 5 illustrates another method of determining whether steam generator 300 is operating abnormally by monitoring whether heater 310 functioning properly. This method will be described hereinafter in more detail.

When the supply of water into steam generator 300 is completed, heater 310 is turned on. The water temperature in steam generator 300 thus raises due to the heat emitted from heater 310. When heater 310 is not working or producing heat, however, the water temperature level in the steam generator 300 does not rise. After heater 310, has been turned on and a predetermined period of time has elapsed, control unit 180 determines whether the water temperature in the steam generator 300 has risen (S112).

Lack of a rise in temperature may indicate various problems. For example, second heater 310 may be out of order resulting in little or no heat emission, or heater 310 may not sufficiently emit heat because the voltage applied is too low. In order to solve this problem, control unit 180 may determine that heater 310 or other parts of the dish washing machine are operating abnormally. For example, control unit 180 may discover abnormal operation when the water temperature has not risen by 3° C. or more one minute after heater 310 is turned on. When the water temperature has not risen by a predetermined degree after heater 310 has been turned on, heater 310 is turned off, and the operation of steam generator 300 is terminated (S120). Subsequently, processes after Step S130 may be carried out.

Further, it is noted that when voltage applied to heater 310 is too low or too high (over-voltage), it may be difficult to normally operate heater 310 and ensure its operational reliability. In addition, heater 310 may be negatively affected and damaged due to improper voltage application. Control unit 180, therefore, checks the voltage applied to heater 310 to determine whether steam generator 300 is operating abnormally. To this end, the dish washing machine includes a voltage measuring unit (not shown) for measuring the voltage applied to heater 310.

When the voltage applied to heater 310 is too low, it may be difficult for heater 310 to sufficiently emit heat, therefore, it is difficult for steam generator 300 to normally generate steam. When too high of voltage is applied to heater 310, on the other hand, heater 310 may overheat, or fuses may blow out.

As illustrated in the flow chart of FIG. 5, control unit 180 determines whether a voltage that is too low or an over-voltage is applied to heater 310 (S114). When too low voltage or over-voltage is applied to heater 310, control unit 180 turns heater 310 off and terminates the operation of steam generator 300 (S120). After that, processes after Step S130 may be carried out.

Heater 310 may overheat when the amount of water in steam generator 300 is insufficient in addition to the case of over-voltage supply as described above. If water level sensor 310 is out of order or malfunctions, heater 310 may be operating even though the water level is low. If steam generator 300 is operating while the water level is below the minimum water level, heater 310 may be at risk of damage due to overheating.

If heater 310 overheats, as described above, an accident, such as a fire, may occur. In order to prevent heater 310 and its surroundings control unit monitors 180 the temperature of heater 310 to determine whether heater 310 is overheated (S116). For example, when heater 310 is heated to or about 110° C. or more, control unit 180 protects heater 310 by turning it off, and terminates the operation of steam generator 300 (S120). After termination of the steam generation, Step S130 and subsequent steps may be carried out. One of skill in the art will appreciate that the temperature may be monitored by any suitable temperature sensor. Further, theses temperatures are exemplary only and one having skill in the art will appreciate that various other temperatures or temperature ranges may be applicable depending on design constraints or requirements.

It will be appreciated by one having skill in the art that the method described above for determining abnormal operation of steam generator 300 and its respective heater 310, may be performed on sump 200 and/or second steam generator 325 and their respective heaters, in order to completely monitor functioning of the washing machine.

Steps S112, S114, and S116, of FIG. 5 may be implemented into the control method individually or in combination. That is, at least two of the specified steps may be simultaneously adopted and applied. The sequence of Steps S112, S114, and S116 is not limited to the example shown in FIG. 5, thus the sequence may be changed. When it is determined during Steps S112, S114, and S116 that the water temperature, the voltage applied to heater 310, and the heat emitted from heater 310 is normal, processes or steps after Step S160 are carried out.

When the main washing process is completed through Steps S140, S150, and S160, control unit 180 performs a control operation such that the contaminated or dirty wash water is discharged, and new wash water is supplied to rinse the dishes. During the rinsing operation, a rinse detergent may be contained in the clean wash water. During the rinsing operation, the clean wash water is sprayed toward the dishes to wash off any foreign matter that may have reattached to the dishes after being removed in previous processes. Even in the rinsing operation, first heater 290 of sump 200 may be operated such that heated wash water can be sprayed toward the dishes. After the dishes are rinsed for a predetermined period of time, the dish washing machine produces a predetermined beep sound to inform the user that the washing course has been completed.

As apparent from the above description, the present invention has the effect of improving the dish washing efficiency through the use of steam during the dish washing process.

In addition, when the steam generator is operating abnormally, the control method of the dish washing machine according to the present invention effectively detects the abnormality of the steam generator and terminates the operation of the steam generator. Consequently, the present invention has the effect of preventing the damage to the dish washing machine, which may occur due to the continuous use of the abnormal steam generator.

Furthermore, the operation of other parts constituting the dish washing machine is continuously performed to complete the predetermined washing course, even after the operation of the steam generator is terminated, according to the present invention. Consequently, the present invention has the effect of accomplishing basic dish washing operation even when the steam generator is out of order.

It will be apparent to those skilled in the art that various modifications and variations can be made. Thus, it is intended that claims covers these modifications and variations.

What is claimed is:

1. A method for controlling a dish washing machine, comprising:

performing a first cycle comprising:

supplying water into a washing compartment through spray arms;

providing steam, generated by a first steam generator, into the washing compartment; and terminating the operation of the first steam generator if it is determined that the first steam generator is operating abnormally; and performing a substitute cycle so as to compensate for the abnormal operation of the first steam generator, wherein the substitute cycle includes supplying water into the washing compartment through the spray arms, and a water spraying manner of the substitute cycle is different from a water spraying manner of the first cycle.

2. The method according to claim 1, wherein the substitute cycle further includes providing steam, generated by a second steam generator that is mounted separately in the dish washing machine, into the washing compartment.

3. The method according to claim 1, wherein the substitute cycle includes supplying water that is heated by a first heater mounted separately from a second heater of the first steam generator, into the washing compartment.

4. The method according to claim 1, wherein supplying the water and supplying the steam are simultaneously or alternately carried out for a predetermined period of time.

5. The method according to claim 1, further comprising:

supplying water to the first steam generator for a predetermined amount of time;

determining if a maximum water level is detected, and if a maximum water level is not detected, terminating the operation of the first steam generator.

6. The method according to claim 1, further comprising:

detecting a temperature of a heater of the first steam generator;

determining if the temperature rises to a predetermined level, and if the temperature rises to the predetermined level, terminating operation of the first steam generator.

7. The method according to claim 1, further comprising:

detecting a temperature of water in the first steam generator;

determining if the temperature rises to a predetermined level, and if the temperature does not rise to the predetermined level, terminating operation of the first steam generator.

8. The method according to claim 1, further comprising:

detecting an applied voltage level of a heater of the first steam generator;

determining if the applied voltage is higher than a predetermined voltage level, and if the applied voltage is higher than the predetermined level, terminating operation of the first steam generator.

9. A method for controlling a dish washing machine, comprising:

performing one cycle comprising;

spraying water into a washing compartment through spray arms;

providing steam, generated by a steam generator, into the washing compartment;

terminating the operation of the steam generator when the steam generator is operating abnormally; and, performing another cycle that modifies the one cycle or substitutes the one cycle so as to compensate for the abnormal operation of the steam generator, wherein the another cycle includes supplying water into the washing compartment through the spray arms, and a water spraying manner of the another cycle is different from a water spraying manner of the one cycle.

* * * * *